US006533361B1

(12) United States Patent
Pietrzak

(10) Patent No.: US 6,533,361 B1
(45) Date of Patent: Mar. 18, 2003

(54) SHROUD FOR THE UNDERSIDE OF A CHAIR, AND A MOLDED SEAT FRAME FOR USE THEREWITH

(76) Inventor: Joseph J. Pietrzak, 8 Selma Dr., Jamesburg, NJ (US) 08831

( * ) Notice: Subject to any disclaimer, the term of this patent is extended or adjusted under 35 U.S.C. 154(b) by 0 days.

(21) Appl. No.: 09/713,387

(22) Filed: Nov. 15, 2000

Related U.S. Application Data

(62) Division of application No. 09/205,786, filed on Dec. 4, 1998, now Pat. No. 6,149,240.

(51) Int. Cl.[7] ..... A47C 7/00
(52) U.S. Cl. ..... 297/440.22
(58) Field of Search ..... 297/452.18, 451.11, 297/440.22, 445.1, 440.1, 452.1, 452.55

(56) References Cited

U.S. PATENT DOCUMENTS

| | | | | | |
|---|---|---|---|---|---|
| 565,231 | A | | 8/1896 | Ring | |
| 878,040 | A | | 2/1908 | Burke | |
| 891,266 | A | | 6/1908 | Koen | |
| 2,063,836 | A | | 12/1936 | Bromagem | 155/178 |
| 2,244,096 | A | | 6/1941 | Brazell | 155/39 |
| 3,133,765 | A | | 5/1964 | Kramer | 297/445 |
| 3,166,030 | A | | 1/1965 | Ludvigsen | 108/155 |
| 3,197,165 | A | | 7/1965 | Gits | 248/187 |
| 3,259,431 | A | | 7/1966 | Gale | 297/303 |
| 3,455,605 | A | * | 7/1969 | Anderson | |
| 3,527,498 | A | * | 9/1970 | Werner | |
| 3,565,486 | A | | 2/1971 | Channon | 297/445 |
| 3,873,155 | A | | 3/1975 | Barecki | 297/445 |
| 3,879,774 | A | * | 4/1975 | Glasser et al. | |
| 3,915,493 | A | | 10/1975 | Brown | 296/63 |
| 3,942,836 | A | * | 3/1976 | Baker | |
| 4,065,181 | A | * | 12/1977 | Gunlock et al. | |
| 4,099,774 | A | * | 7/1978 | Sandham | |
| 4,147,336 | A | * | 4/1979 | Yamawaki et al. | |
| 4,208,072 | A | | 6/1980 | Iskendarian | 297/440 |
| 4,332,419 | A | | 6/1982 | Vogel | 297/443 |
| 4,742,984 | A | | 5/1988 | Cote | 248/503.1 |
| 4,761,036 | A | * | 8/1988 | Vogel | |
| 4,775,187 | A | | 10/1988 | Herr | 297/378 |
| 4,880,276 | A | * | 11/1989 | Shovar | |
| 5,064,247 | A | | 11/1991 | Clark et al. | 297/445 |
| 5,499,883 | A | | 3/1996 | Heinzel | 403/219 |
| 5,590,930 | A | | 1/1997 | Glockl | 297/313 |
| 5,649,783 | A | | 7/1997 | Ichikawa et al. | 403/386 |
| 5,655,815 | A | * | 8/1997 | Lohmeyer | |
| 5,662,381 | A | | 9/1997 | Roossien et al. | 297/301.1 |
| 5,688,024 | A | | 11/1997 | Arizpe-Gilmore | 297/217.1 |
| 5,820,221 | A | | 10/1998 | Greaves et al. | 297/378.14 |

* cited by examiner

*Primary Examiner*—Milton Nelson, Jr.
(74) *Attorney, Agent, or Firm*—Lerner, David, Littenberg, Krumholz & Mentlik, LLP

(57) ABSTRACT

A reinforcing frame for a seat is molded to include at least one connecting member for removably connecting a shroud to the underside of the seat, as well as other features for facilitating assembly of the various components to the underside of the seat.

3 Claims, 7 Drawing Sheets

SHROUD FOR THE UNDERSIDE OF A CHAIR, AND A MOLDED SEAT FRAME FOR USE THEREWITH

CROSS-REFERENCE TO RELATED APPLICATIONS

This is a divisional application of application Ser. No. 09/205,786, filed Dec. 4, 1998, to be issued as U.S. Pat. No. 6,149,240 on Nov. 21, 2000.

FIELD OF THE INVENTION

The present invention relates generally to chairs, and more particularly to chairs of the type having a seat and at least one leg connected to the seat for supporting same. Still more particularly, the present invention is directed to a shroud which is removably connectable to the underside of the seat to hide the interconnection between the legs and the seat and thereby present a neat appearance. The invention is also directed to a molded seat frame adapted for connection of the shroud thereto.

BACKGROUND OF THE INVENTION

Chairs and other seats come in a variety of styles depending upon their intended use. A style of chair which is particularly popular is that which includes an upholstered sitting surface or seat, an upholstered back rest connected to the seat, and a plurality of legs, typically four, connected to the underside of the seat. Such chairs are often found in restaurants, diners, banquet halls, hotels and other such establishments.

Since these chairs are frequently used in decorated surroundings, efforts have been made to increase their aesthetic appeal, including forming the chairs with decorative shapes, colors, upholstering and other decorative features. Other efforts have been made to hide the unsightly underside of the seats which includes screws connecting the legs and back rest to the seat, staples holding the fabric covering for the seat in place, manufacturer labels and tags and the like. A conventional approach for covering these eyesores has been to staple or tack a simple cardboard panel to the underside of the seat along its periphery. Although this cardboard panel may be visible when the chair is viewed in elevation from a moderate distance, it nonetheless presents a neater and less objectionable appearance than would be the case if it were not used.

Over the years, several drawbacks to the use of these cardboard panels have been realized. Firstly, it is a time-consuming and costly process to staple or tack the cardboard panel to the underside of the seat. In addition, the cardboard panel frequently becomes wet, such as from contacting the damp surface of an adjacent seat as the chairs are stacked for storage. As a result of repeated contact with moisture, the cardboard panel deteriorates over time, causing it to buckle, sag and/or tear, at which point it no longer serves its function of providing a neat appearance. Moreover, the cardboard panel may become damaged to the point that the screws on the underside of the seat become exposed, resulting in local fraying, tearing, rust staining and other damage to the upholstered sitting surface of an adjacent seat in a stacked arrangement of chairs. Yet another problem with these cardboard panels is that, when they must be removed to provide access to the underside of the seat, such as for tightening or replacing the chair legs or back rest, repairing the upholstery, etc., their removal and reinstallation is time consuming and difficult, often causing damage to the panels.

In view of these drawbacks, there exists a need for an improved device for covering the various connections on the underside of a chair seat. Preferably, such device will not be affected by moisture. More preferably, the device will be capable of easy attachment to and removal from the underside of conventional prior art seats with only simple modifications thereto. There is also a need for a seat to which such device may be readily connected without the need for modification.

SUMMARY OF THE INVENTION

The present invention addresses these needs.

One aspect of the present invention provides a shroud for a chair of the type having a seat and a plurality of legs connected to an underside of the seat. The shroud may include a generally flat panel adapted to overlie a major portion of the underside of the seat, with a lip projecting from a peripheral edge of the panel. The lip may have a series of openings, each opening being sized and shaped to receive one of the plurality of legs through the lip. The shroud may further include at least one connecting member on the panel adapted to engage a complementary connecting member on the underside of the seat for removably connecting the shroud to the seat.

In a preferred embodiment, sections of the lip may include a first wall member extending in a first direction from the panel, a second wall member extending from the first wall member in a direction transverse to the first direction, and a third wall member extending from the second wall member in the first direction, the first, second and third wall members together defining a reinforcing step in the lip.

In another preferred embodiment, the at least one connecting member may be resiliently deformable for removably engaging the complementary connecting member on the underside of the seat. Desirably, the at least one connecting member includes first and second fingers projecting from the panel, the first finger having a shoulder formed on a free edge thereof so as to project in a direction away from the second finger, the second finger having a shoulder formed on a free edge thereof so as to project in a direction away from the first finger, the first and second fingers being resiliently deformable so as to move their free ends toward one another.

In a variant of this aspect of the present invention, a shroud is provided for a chair of the type having at least one leg connected to the underside of the seat. The shroud may include a generally flat panel adapted to overlie a major portion of the underside of the seat, a lip projecting from a peripheral edge of the panel, and at least one connecting member on the panel adapted to engage a complementary connecting member on the underside of the seat for removably connecting the shroud to the seat. In one embodiment hereof, the shroud may include a channel in the panel having an open end, the channel being adapted to receive the at least one leg of the chair. In another embodiment hereof, the panel may include a first portion adapted to overlie one portion of the underside of the seat and a second portion adapted to overlie another portion of the underside of the seat. The first and second portions each have mating edges with a recess formed therein, and at least one connecting member adapted to engage a complementary connecting member on the underside of the seat for removably connecting the first and second portions in an assembled position to the seat. In the assembled position, the mating edges of the first and second portions abut one another with the recesses aligned with one another to define an aperture in the panel adapted to receive the at least one leg of the chair.

Another aspect of the present invention provides a chair including a seat having a sitting surface and an underside opposite the sitting surface, at least one leg connected to the underside of the seat, and at least one first connecting member on the underside of the seat. A shroud removably connected to the underside of the seat may include a generally flat panel adapted to overlie a major portion of the underside of the seat, a lip projecting from a peripheral edge of the panel, and at least one second connecting member on the panel for engaging the at least one first connecting member to removably join the shroud to the seat.

In preferred embodiments in accordance with this aspect of the present invention, sections of the lip may include a first wall member extending in a first direction from the panel, a second wall member extending from the first wall member in a direction transverse to the first direction, and a third wall member extending from the second wall member in the first direction, the first, second and third wall members together defining a reinforcing step in the lip.

In other preferred embodiments hereof, the at least one second connecting member is resiliently deformable for removably engaging the at least one first connecting member on the underside of the seat. Preferably, the at least one second connecting member includes first and second fingers projecting from the panel, the first finger having a shoulder formed on a free edge thereof so as to project in a direction away from the second finger, the second finger having a shoulder formed on a free edge thereof so as to project in a direction away from the first finger, the first and second fingers being resiliently deformable so as to move their free ends toward one another.

A still further aspect of the present invention provides a frame member for a seat. The frame member may include an injection molded body having a top surface, a bottom surface, a front edge, a rear edge and a pair of side edges. A skirt may be formed integrally with the body so as to depend from the body along the front edge and the side edges thereof. A locating member may also be formed integrally with the body, the locating member defining a position for connecting at least one leg to the body. In preferred embodiments hereof, the frame member may further include at least one connecting member adapted to engage a complementary connecting member on a shroud for removably connecting the shroud to the bottom surface of the body. In other preferred embodiments hereof, the frame member may further include an auxiliary wall extending between the skirt and the bottom surface of the body for providing a securement surface for securing an upholstery material to a bottom of the body. A lip may project from the auxiliary wall for defining material securement locating positions on the bottom of the body.

In a variant of this last aspect of the present invention, the frame member may include a body having a top surface, a bottom surface, a front edge, a rear edge and a pair of side edges, and at least one connecting member adapted to engage a complementary connecting member on a shroud for removably connecting the shroud to the bottom surface of the body.

BRIEF DESCRIPTION OF THE DRAWINGS

A more complete appreciation of the subject matter of the present invention and the various advantages thereof can be realized by reference to the following detailed description, in which reference is made to the accompanying drawings in which.

BRIEF DESCRIPTION OF THE PREFERRED EMBODIMENTS

In the following, the structure and operation of the shroud of the present invention are described in association with a well-known type of chair having a seat with an upholstered sitting surface, a back rest connected to the seat and a series of four legs connected to the underside of the seat. Such chairs are commonly found in restaurants, diners, banquet halls, hotels and similar commercial establishments. It will be appreciated, however, that the shroud of the present invention is not limited to chairs of this type. Rather, as used herein, the term "chair" refers to any device providing a sitting surface and at least one leg or pedestal connected to the underside of the sitting surface for supporting same. Thus, the term "chair" is intended to include sitting surfaces supported by more or less than four legs, stools or other sitting surfaces having no back rests, and sitting surfaces which are not upholstered.

Figure 3:
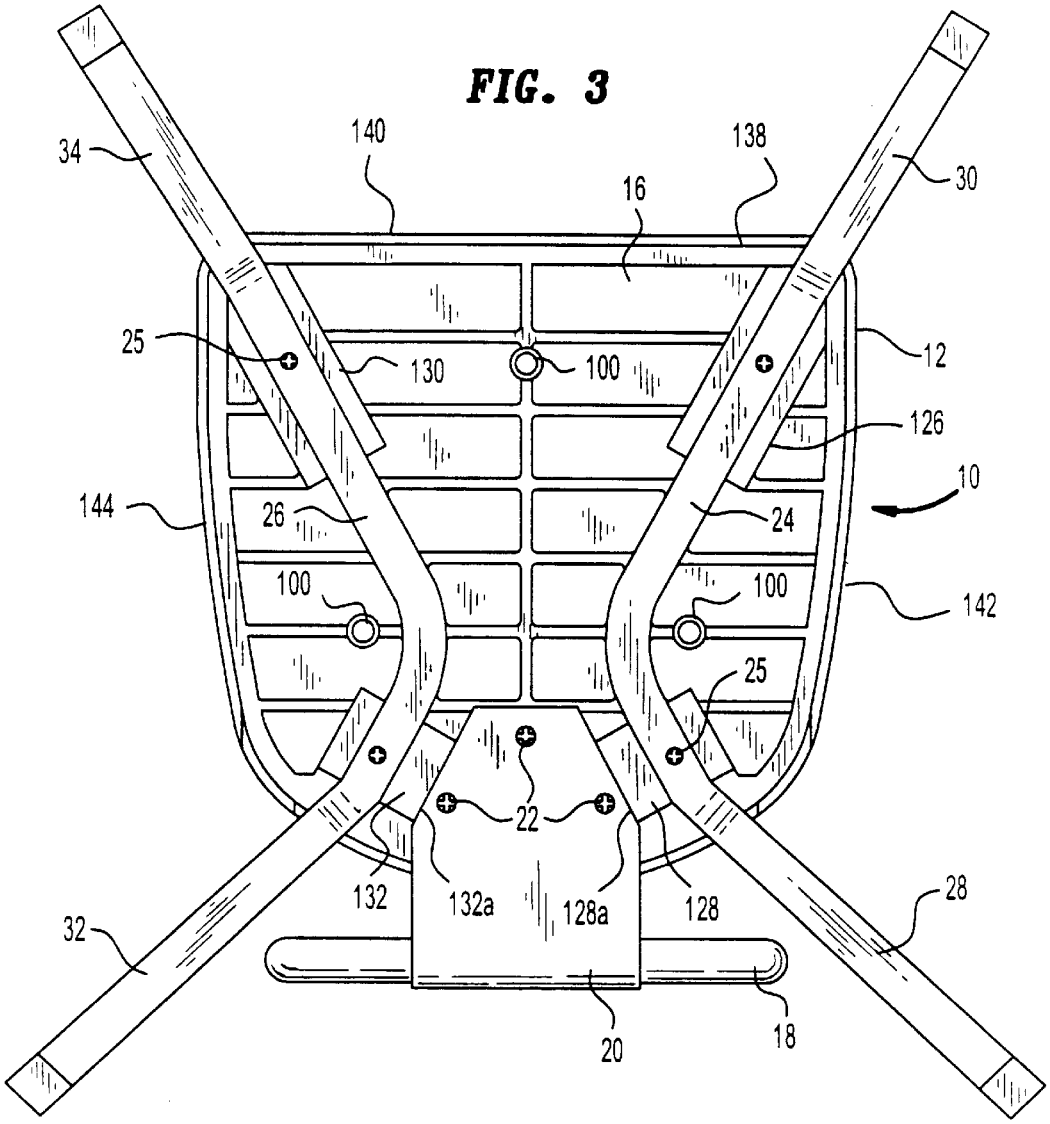
FIG. 3 is a bottom plan view of a chair incorporating the molded seat frame of FIG. 2.
Figure 4:
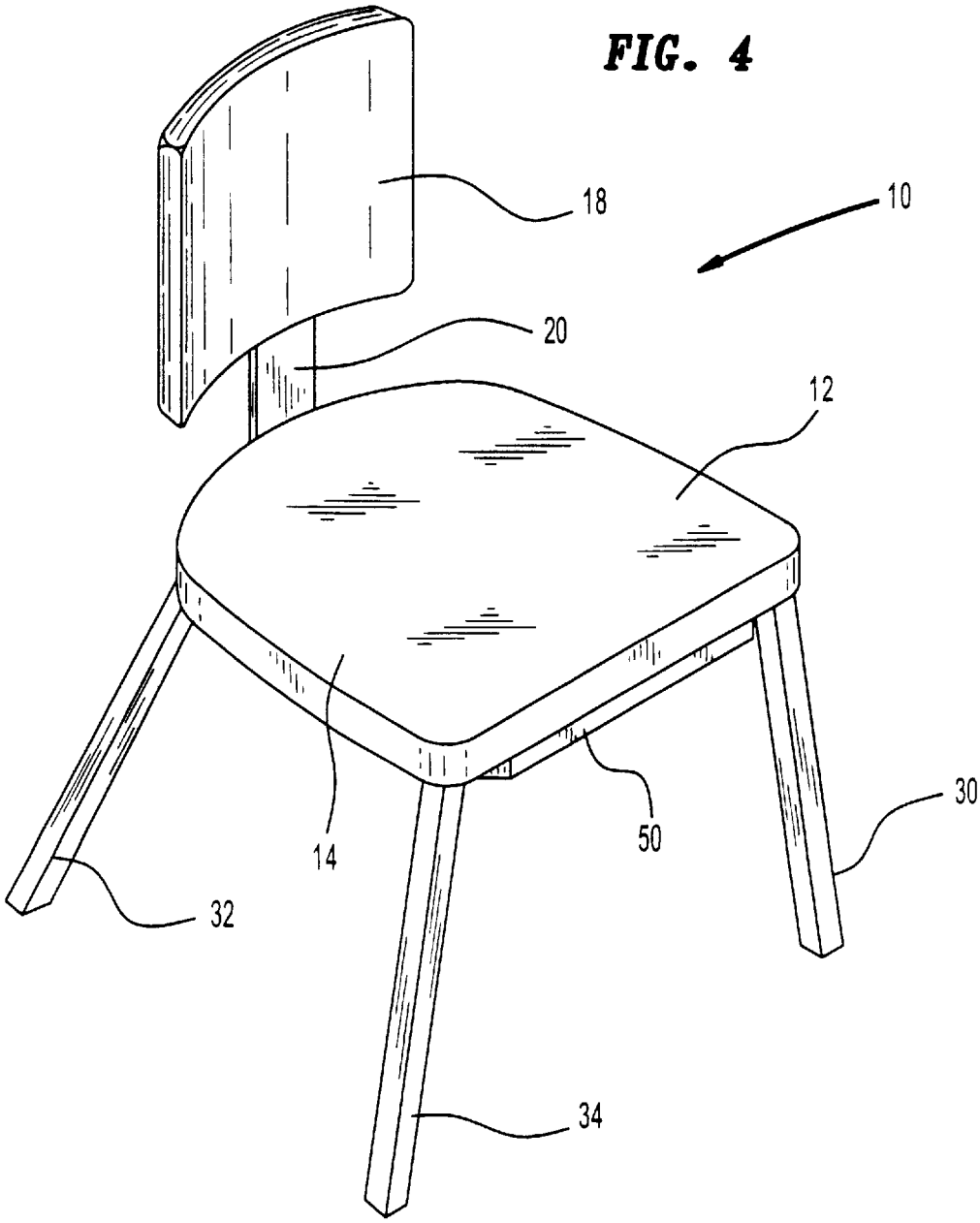
FIG. 4 is a perspective view of the chair of FIG. 3 with the seat bottom shroud assembled thereto.
Figure 5:
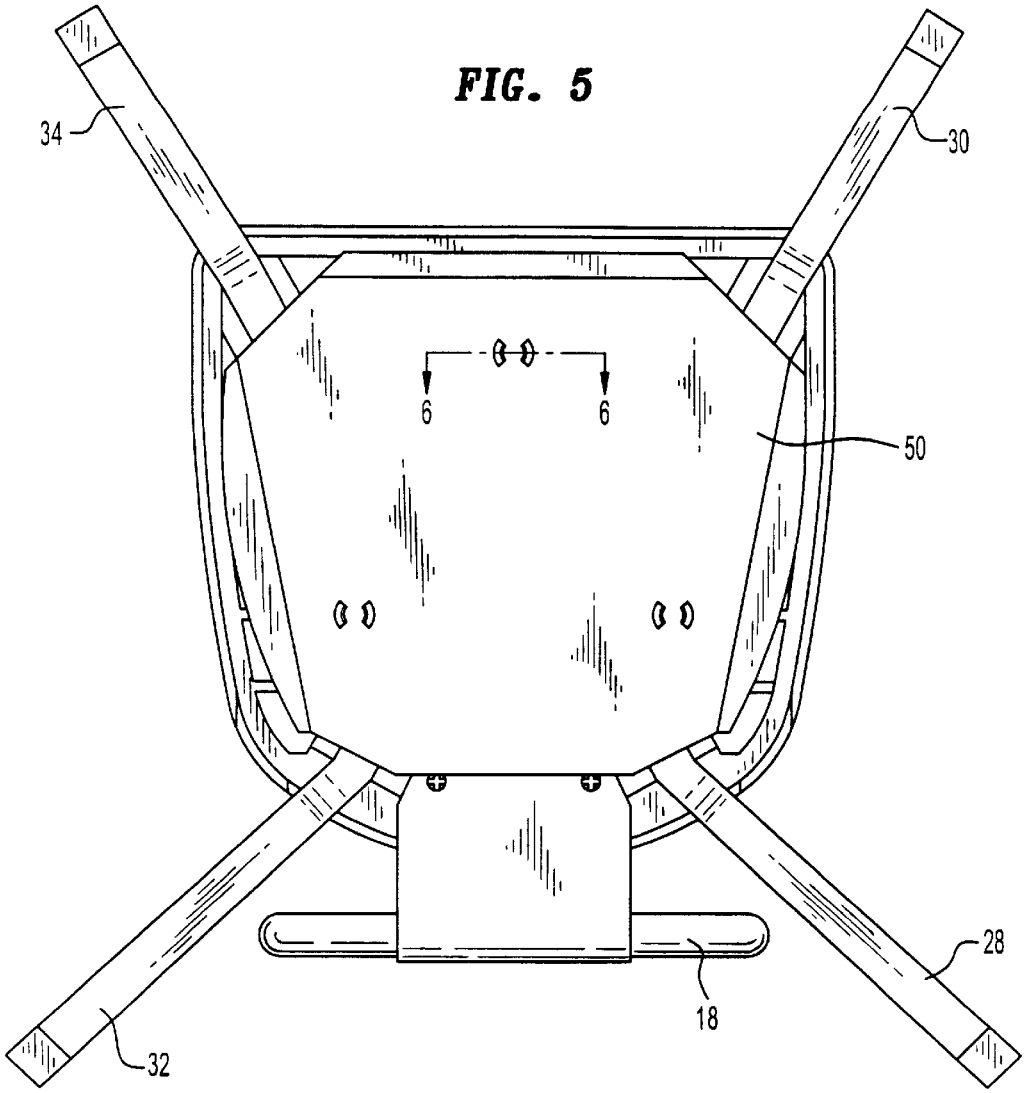
FIG. 5 is a bottom plan view of the chair of FIG. 4 with the seat bottom shroud assembled thereto.
Figure 6:
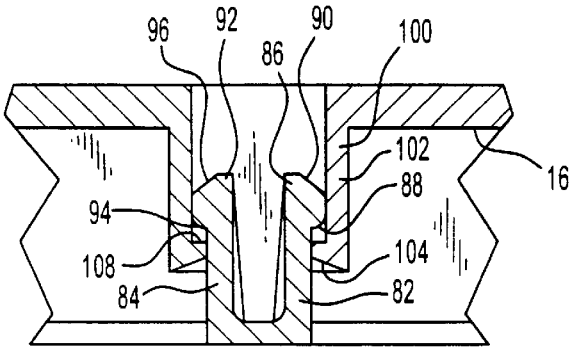
FIG. 6 is a partial cross-sectional view taken along line 6—6 of FIG. 5.

Referring to the figures, one chair 10 with which the shroud of the present invention may be used is illustrated in FIGS. 3 and 4. Chair 10 includes a seat 12 having an upholstered sitting surface 14 for supporting a person sitting on the chair, and an underside 16 opposite the sitting surface. A back rest 18 is connected by a bracket 20 to the underside of the seat. Bracket 20 may be connected to the underside of the seat by a plurality of screws 22, as illustrated. Also connected to the underside of the seat are two leg members 24 and 26, which may be fastened in place by a plurality of screws 25. Each leg member may be formed from a single hollow tube which has been bent or otherwise shaped to define two downwardly depending legs, leg member 24 defining legs 28 and 30, and leg member 26 defining legs 32 and 34. Leg members 24 and 26 conventionally may be formed from metal tubing having a square cross-section, although different materials, such as molded or extruded plastic, and different cross-sectional shapes may be employed. Although not shown in the figures, the underside of conventional seats 12 of the prior art include a reinforcing frame member, typically in the form of a wooden board, for attaching the back rest, legs and upholstery to the seat. A strip of vinyl or another rigid or semi-rigid material (not shown) may be fastened along the front and side edges of the frame member so as to form a border projecting downwardly therefrom. The border gives the seat the appearance of increased thickness and helps obscure the various connections to the underside of the seat.

Figure 1:
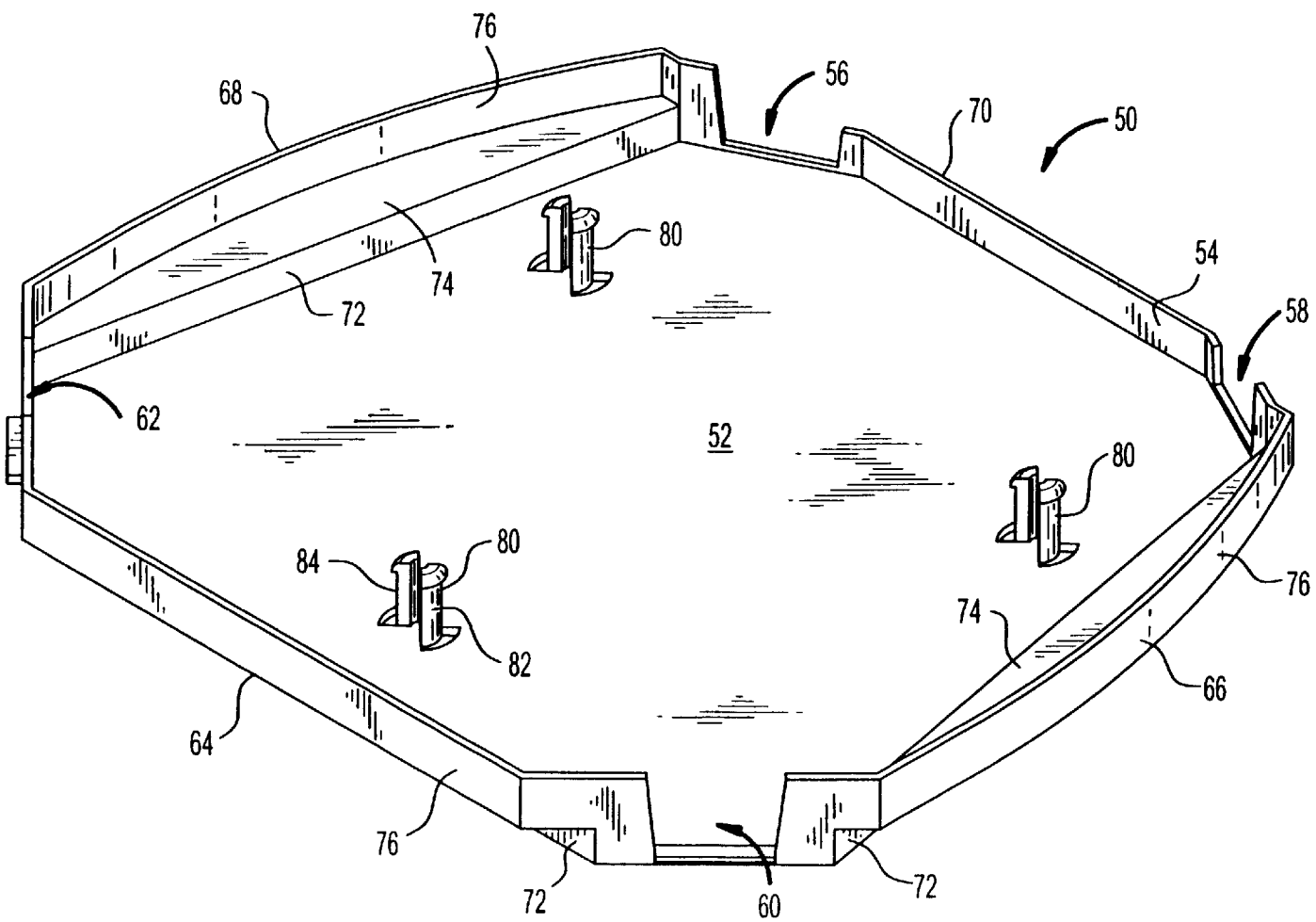
FIG. 1 is a perspective view of a seat bottom shroud in accordance with the present invention.

A shroud 50 in accordance with one embodiment of the present invention is shown in FIG. 1. Preferably, shroud 50 has a one-piece construction which may be stamped or otherwise formed from metal sheet materials or molded from thermoplastic or thermosetting materials using injection molding techniques. Particularly preferred materials for molding shroud 50 include polyethylene, ethylene copolymers, polystyrene, polystyrene copolymers, polypropylene and acrylonitrite butadiene styrene.

Shroud 50 has a generally flat panel 52 which is shaped to approximate the peripheral shape of seat 12 and sized to overlie a major portion of the underside 16 of the seat. A lip 54 is formed along the peripheral edge of panel 52 and projects upwardly therefrom. Lip 54 includes a series of cutout openings 56, 58, 60 and 62 situated in positions which, with shroud 50 assembled to chair 10, correspond to the positions of chair legs 28, 30, 32 and 34. These openings may divide lip 54 into four discrete segments, namely, segment 64 on the front edge of panel 52, segments 66 and 68 on the side edges of panel 52, and segment 70 on the rear edge of panel 52. Front segment 64 and side segments 66 and 68 may each consist of a first wall member 72 projecting upwardly from panel 52, a second wall member 74 projecting outwardly from the uppermost edge of wall member 72, and a third wall member 76 projecting upwardly from the outermost edge of second wall member 74, wall members 72, 74 and 76 together defining a step in segments 64, 66 and 68. In a preferred arrangement, the third wall member 76 in segments 66 and 68 may be curved outwardly to more closely conform to the curved sides of seat 12. Rear segment 70, on the other hand, may consist of a single wall projecting upwardly from panel 52. Rear segment 70 may have a height from panel 52 which is greater than the height of first wall members 72 described above, but preferably not as high as the total height of segments 64, 66 and 68 so that, with shroud 50 connected to chair 10 as described below, a gap is created between the free edge of rear segment 70 and the underside 16 of seat 12 for accommodating back rest bracket 20. It will be appreciated that, where shroud 50 is to be used in connection with a chair which does not have a back rest 18, the rear segment 70 of the shroud may have the same three wall member stepped structure as segments 64, 66 and 68.

Shroud 50 also includes one or more connecting members for connecting shroud 50 to the underside 16 of seat 12. The connecting members may be of any type which enable shroud 50 to be quickly and easily connected to and removed from the seat. In one arrangement, shroud 50 may be joined to the seat by a snap-fit interconnection between connecting members on the shroud and corresponding connecting members on the seat. A preferred embodiment of such arrangement, shown in the figures, may include one or more resiliently deformable connecting members 80 on shroud 50 and a corresponding number of fixed connecting members 100 on the underside of the seat. More particularly, each connecting member 80 may include a pair of fingers 82 and 84 projecting upwardly by a predetermined distance from panel 52. A space between fingers 82 and 84 permits the fingers to be resiliently deflected toward one another. Preferably, fingers 82 and 84 diverge away from one another so as to permit a greater amount of deflection at their free ends. At its free end, leg 82 includes an arcuate projection 86 defining a shoulder 88 extending in a direction away from leg 84 and a tapered upper surface 90. Similarly, at its free end, leg 84 has an arcuate projection 92 defining a shoulder 94 projecting away from finger 82 and a tapered upper surface 96. Shroud 50 may include a sufficient number of connecting members 80 to provide a secure connection between the shroud and the seat. In the preferred embodiment shown in FIG. 1, shroud 50 includes three such connecting members 80.

The underside 16 of seat 12 includes a connecting member 100 corresponding to each connecting member 80 on shroud 50. Each connecting member 100 includes a generally cylindrical wall 102 which extends a predetermined distance from the underside 16 of the seat. At its free end, wall 102 is formed with an inwardly projecting annular rim 104 defining an opening 106 at the end of connecting member 100 and an annular shoulder 108.

To connect shroud 50 to chair 10, shroud 50 is positioned below seat 12 so that connecting members 80 on the shroud are aligned with connecting members 100 on the seat, and openings 56, 58, 60 and 62 are aligned with chair legs 28, 30, 32 and 34, respectively. Shroud 50 is then simply pushed against the underside 16 of the seat, whereupon the tapered surfaces 90 and 96 on each connecting member 80 engage the annular rim 104 on the end of the corresponding connecting member 100. Upon the continued application of pressure against shroud 50, the engagement of tapered surfaces 90 and 96 against annular rim 104 causes fingers 82 and 84 to be deflected toward one another as their free ends are guided into opening 106. Eventually, connecting members 80 are pushed into connecting members 100 by an amount sufficient for arcuate projections 86 and 92 to clear annular rim 104, completing the assembly procedure. At this juncture, shoulders 88 and 94 on connecting members 80 engage the annular shoulder 108 on connecting member 100 to hold shroud 50 in assembled relationship to seat 12. Removal of shroud 50 from the seat is accomplished just as easily. In that regard, shoulders 88 and 94 preferably have rounded outer edges causing fingers 82 and 84 to be deflected toward one another as connecting members 80 are pulled through corresponding openings 106.

It will be appreciated that, in order to complete the connection of shroud 50 to the underside of seat 12, the total height of segments 64, 66 and 68 from panel 52 to their free edges must be no greater than the combined height of connecting members 80 from panel 52 to shoulders 88 and 94 and connecting members 100 from the underside of seat 12 to shoulder 108. That is, if segments 64, 66 and 68 have a height which is too large, the free edges of the segments will contact the underside 16 of seat 12 before shoulders 88 and 94 engage annular shoulder 108, thereby preventing assembly. Preferably, segments 64, 66 and 68 have a height which is slightly less than the combined height of connecting members 80 and 100 in the assembled position so as to accommodate the upholstery fabric extending between the free ends of the segments and the underside 16 of the seat while still fitting snugly against the bottom of the seat to thereby prevent rattling of the shroud against the seat. Moreover, the step formed in segments 64, 66 and 68 structurally reinforces the segments so as to minimize their outward flexing from the tugging of the upholstery fabric as a person sits on the seat. With shroud 50 assembled to seat 12, a large gap (not shown) will be formed between the free edge of rear segment 70 and the underside of the seat to accommodate the passage of bracket 20.

In its assembled relationship to chair 10, shroud 50 hides the various connections to the underside of seat 12, thus presenting a neat and finished appearance, as illustrated in FIG. 4. A further feature of the present invention is that various manufacturer labels, trademarks and other information may be molded directly into shroud 50, rather than being printed on a label which is glued, stapled or otherwise adhered to the bottom of seat 12, and which thus may be damaged or come loose over time. Simply by changing an insert in the mold for forming shroud 50, each group of shrouds may be molded with the specific information desired by a particular chair manufacturer.

Any number of arrangements may be devised for removably connecting shroud 50 to the underside of the seat, and thus the present invention is not limited to the use of connecting members 80 and 100 described above. For example, rather than having three separate pairs of fingers 82 and 84, shroud 50 may be formed with three single fingers each having a transverse shoulder formed on its free end for engaging undercut structures formed at corresponding locations on the underside of seat 12. Alternatively, the underside of seat 12 may be formed with tabs which may be pivoted into place to engage wall members 74 or other surfaces of shroud 50 formed parallel to panel 52 to lock shroud 50 in place on the underside of seat 12. In a further arrangement, shroud 50 may be formed with connecting members having spherical or similarly shaped surfaces at their free ends for engaging appropriately sized apertures on the underside of seat 12 in snap-fit relationship.

In yet another embodiment, a camming arrangement may be used to hold shroud 50 to the underside of seat 12. In such arrangement, shroud 50 may be formed with a plurality of connecting members in the form of elongated fingers having a first diameter with free ends having an enlarged diameter. The underside of seat 12 may be formed with corresponding apertures which are sized to receive the enlarged free ends of the connecting members and which have formed adjacent thereto and in communication therewith apertures having a diameter smaller than the enlarged diameter but slightly larger than the first diameter so as to receive the elongated fingers of the connecting members. Thus, shroud 50 may be connected to the underside of seat 12 by inserting the enlarged free ends of the connecting members into the large diameter apertures on the underside of the seat and then rotating the shroud until the elongated fingers having the smaller diameter reside in the smaller diameter apertures on the underside of the seat. This action will lock the shroud to the seat since the enlarged free ends of the connecting members on the shroud will be unable to pass through the smaller diameter apertures on the underside of the seat. To accommodate this rotational movement, shroud 50 may be formed with openings 56, 58, 60 and 62 which are wider than the width of the chair legs so that the engagement of the chair legs in these openings does not prevent shroud 50 from rotating the small amount needed to lock shroud 50 to the seat.

It will be appreciated, of course, that all of the various arrangements described above for connecting the shroud to the seat may be reversed in position, such that the connecting members described as being on shroud 50 may be placed on the underside of seat 12, and the connecting members described as being on the underside of seat 12 may be placed on shroud 50.

As described above, a conventional chair 10 of the prior art would have a wooden board or similar frame structure on the underside of seat 12 and thus would not include individual connecting members 100. However, such chairs may be easily retrofitted to receive shroud 50 by securing a plurality of individual connecting members 100 in appropriate locations on the underside of the seat using conventional techniques. For example, connecting member 100 may be formed with a solid wall on the end opposite opening 106, and a screw, nail or other fastener may be inserted through the wall to secure the connecting member to the board forming the underside of the seat. Alternatively, connecting member 100 may be formed with an outer flange at the end opposite opening 106 for securing the connecting member to the underside of the seat. Thus, simply by attaching connecting members 100 to the underside of seat 12, shroud 50 may be used on conventional chairs of the prior art.

Figure 2:
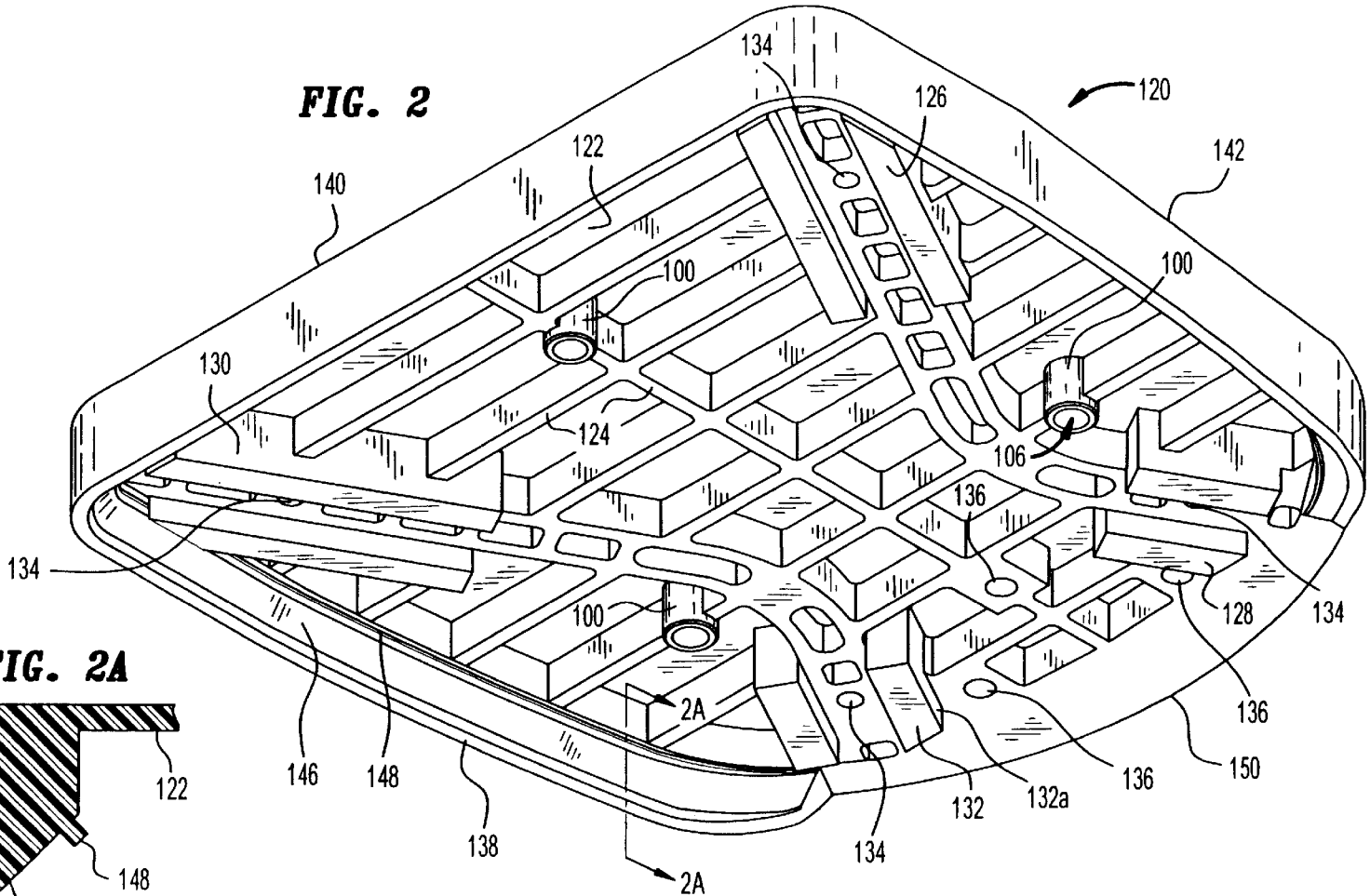
FIG. 2 is a perspective view of a molded seat frame for use with the shroud of FIG. 1.
Figure 2A:
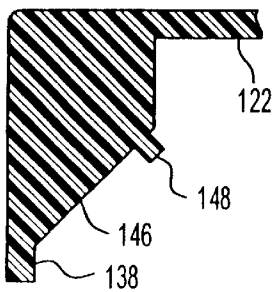
FIG. 2A is a partial cross-sectional view taken along line 2A—2A of FIG. 2.

In an alternate arrangement forming another aspect of the present invention, the reinforcing frame of seat 12 may be formed with integral connecting members, such as connecting members 100, as well as other features for facilitating the connection of the various components thereto. A preferred embodiment of a reinforcing frame 120 for seat 12 incorporating connecting members 100 in accordance with the present invention is shown in FIG. 2. In a preferred arrangement, frame 120 may be injection molded from a thermoplastic or thermosetting plastic material, particularly preferred plastic materials including polypropylene, polyethylene, ethylene copolymers, polystyrene and polystyrene copolymers.

Frame 120 includes a top panel 122 having a generally smooth upper surface (not shown) and a plurality of reinforcing ribs 124 on its lower surface for providing structural strength to frame 120 without substantially increasing its weight. A first pair of raised members 126 and a second pair of raised members 128 define positions for readily locating leg member 24 in the proper position relative to the underside of the seat. Similarly, a first pair of raised members 130 and a second pair of raised members 132 define positions for locating leg member 26 relative to the underside of the seat. Threaded apertures 134 may be provided for receiving screws 25 to connect leg members 24 and 26 to the frame. Additional threaded apertures 136 may be provided to receive screws 22 for securing back rest bracket 20 to frame 120. In this regard, the raised members 128 and 132 may be positioned so that their facing surfaces 128*a* and 132*a* define locating surfaces for positioning bracket 20 relative to the underside of the seat.

Frame 120 may include a skirt 138 depending from its periphery along front edge 140 and side edges 142 and 144. Skirt 138 takes the place of the strip of vinyl or other material secured to the edge of prior art frame members and provides seat 12 with a thicker appearance while at least partially obscuring the various connections to the underside of the seat. An angled wall or fillet 146 may be provided on the underside of frame 120 along its intersection with skirt 138. Wall 146 provides a readily accessible surface for stapling, tacking or otherwise fastening a fabric layer to the underside of the seat. Along its inner edge, wall 146 may include a raised lip 148 for accurately locating a stapler or other fastening tool at appropriate positions around the periphery of frame 120. Wall 146 is not needed along the rear edge 150 of frame 120 since the absence of skirt 138 along the rear edge of the frame permits the underside of the frame to be readily accessed by a stapler or other fastening tool. It will be appreciated, however, that the underside of frame 120 may be provided with a raised lip (not shown) at a spaced distance from rear edge 150 which may serve as a stop for positioning a fastening tool.

Figure 7:
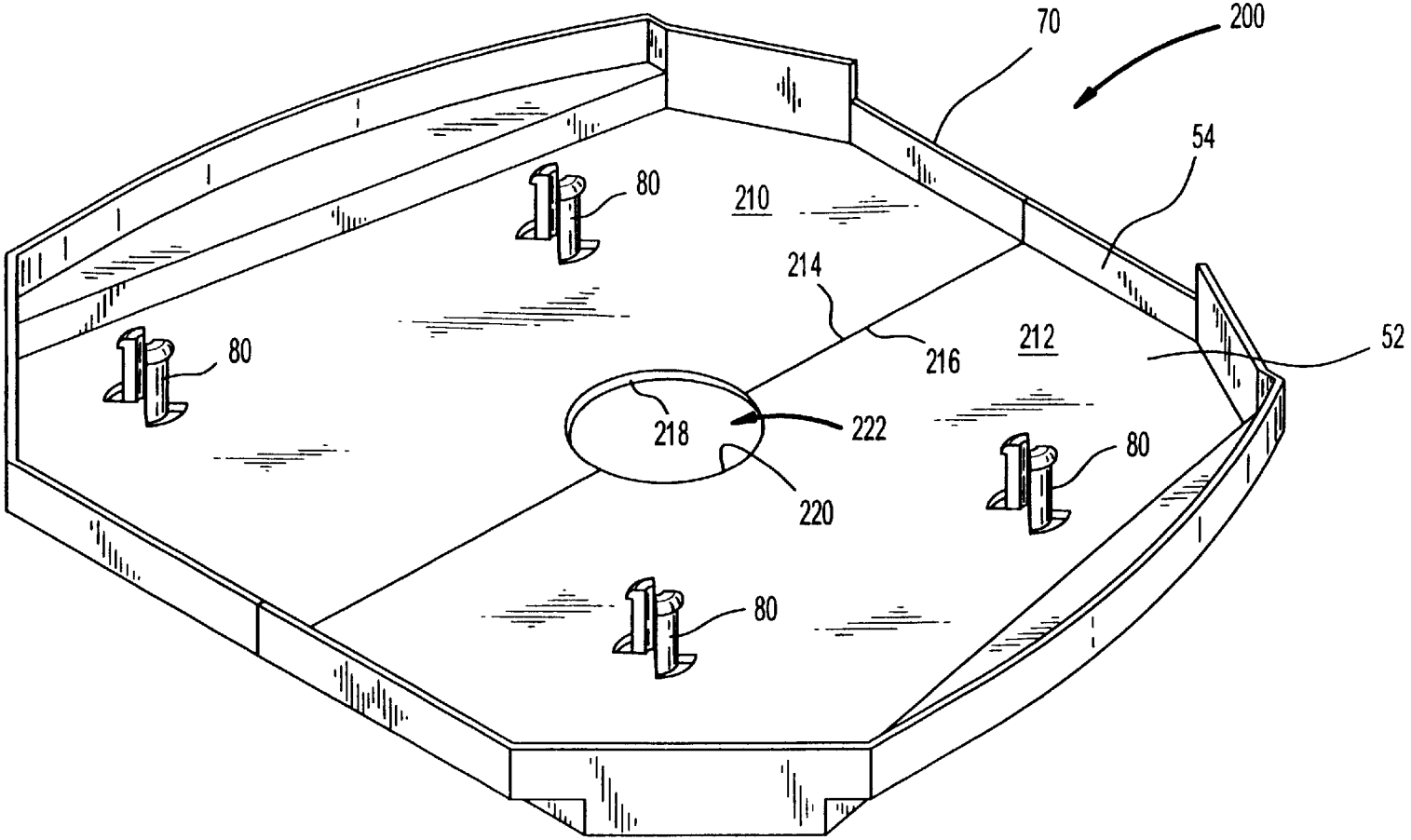
FIG. 7 is a perspective view of a seat bottom shroud in accordance with a second embodiment of the present invention.

The present invention is not limited to shrouds for hiding the underside of chairs having a plurality of legs connected thereto. That is, the shrouds of the present invention may be employed to hide the interconnection of a single leg or pedestal to the underside of the chair seat. A shroud 200 in accordance with one such arrangement is shown in FIG. 7. Shroud 200 may be substantially the same as shroud 50 described above, but the lip 54 projecting upwardly from the peripheral edge of the shroud does not include cutout openings 56, 58, 60 and 62 for accommodating the legs of the chair. Moreover, shroud 200 may be formed in two halves 210 and 212 which may be separately connected to the underside of a seat so that the confronting edges 214 and 216 of the halves abut one another. Each of confronting edges 214 and 216 may include an appropriately sized and shaped notch or recess 218 and 220, respectively, so that, in the assembled position of halves 210 and 212, the recesses align with one another and together define an aperture 222 through panel 52 of the shroud which receives the support leg or pedestal of the chair. Shroud halves 210 and 212 each have an appropriate number of connecting members 80 to enable a secure connection to the underside of the seat.

Figure 8:
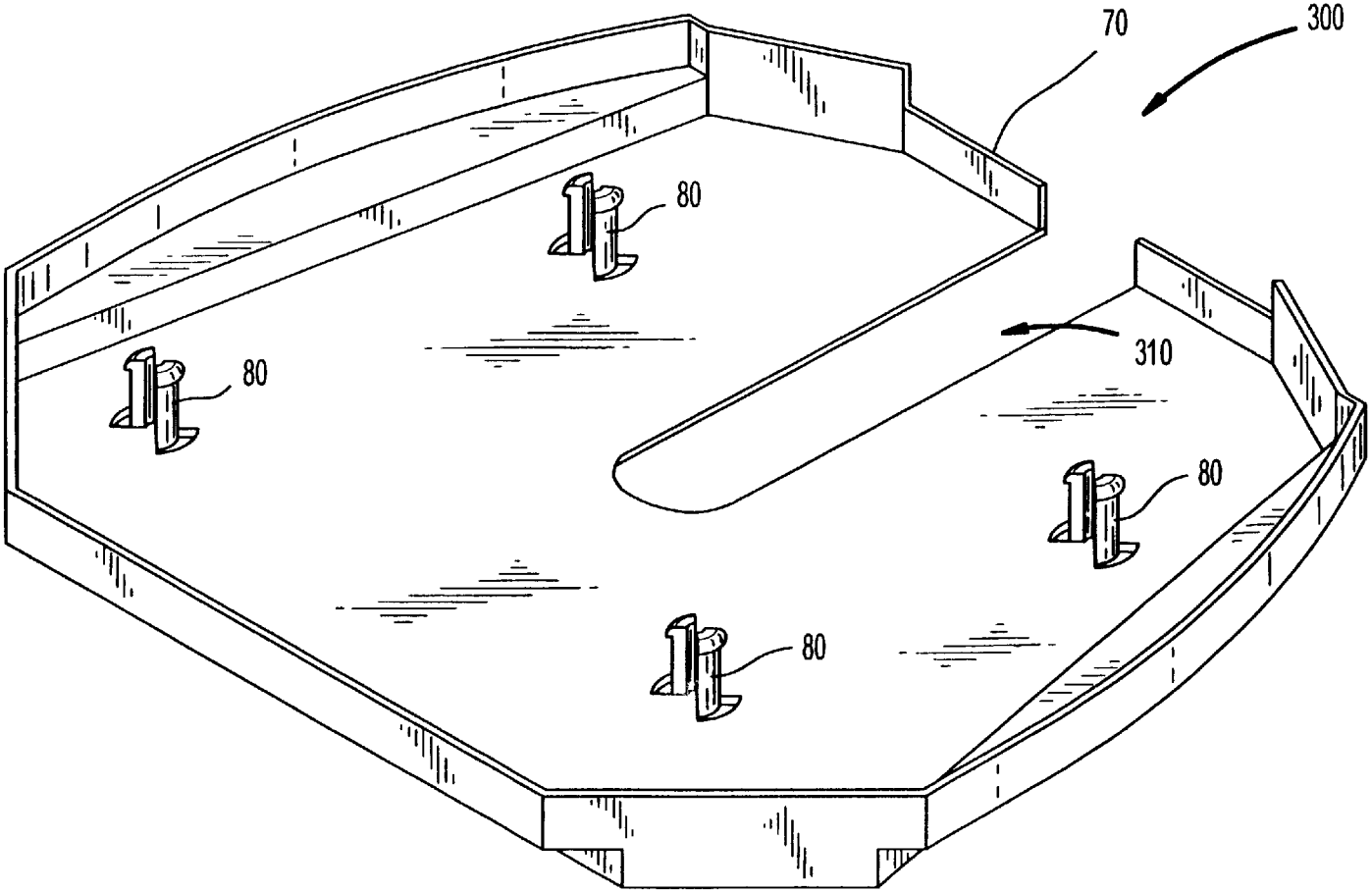
FIG. 8 is a perspective view of a seat bottom shroud in accordance with a third embodiment of the present invention.

In an alternate embodiment for use with chairs having a single leg or pedestal, the shroud may be formed as a single unit with an elongated channel extending inwardly from one edge of the shroud. A shroud 300 according to this embodiment of the invention is illustrated in FIG. 8. Shroud 300 is formed with a channel 310 having a width sufficient to accommodate the cross-sectional size of the chair leg or pedestal, and a length sufficient to permit the shroud to be assembled in the proper position to the underside of the seat. In those cases where the chair has a back rest such that the rear segment 70 of shroud 300 consists of a single upstanding wall lower in height than the remainder of lip 54, channel 310 preferably extends inwardly from rear segment 70 so as to detract as minimally as possible from the overall appearance of the chair when shroud 300 is connected thereto.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as set forth in the appended claims.

I claim:

1. A frame member for a seat, comprising an injection molded body having a top surface, a bottom surface, a front edge, a rear edge and a pair of side edges;

a skirt formed integrally with said body and depending from said body along said front edge and said side edges thereof;

a locating member directly on said bottom surface of said body and defining a position on said bottom surface of said body for connecting at least one leg to said body; and at least one connecting member directly on said bottom surface of said body adapted to engage a complementary connecting member on a shroud for removably connecting the shroud to said bottom surface of said body.

2. The frame member as claimed in claim 1, further comprising an auxiliary wall extending between said skirt and said bottom surface of said body for providing a securement surface for securing an upholstery material to a bottom of said body.

3. A frame member for a seat, comprising an injection molded body having a top surface, a bottom surface, a front edge, a rear edge and a pair of side edges;

a skirt formed integrally with said body and depending from said body along said front edge and said side edge thereof;

a locating member formed integrally with said body and defining a position for connecting at least one leg to said body;

an auxiliary wall extending between said skirt and said bottom surface of said body for providing a securement surface for securing an upholstery material to a bottom of said body; and a lip projecting from said auxiliary wall for defining material securement locating positions on said bottom of said body.

* * * * *